US009701528B2

(12) United States Patent
Gonzalez et al.

(10) Patent No.: US 9,701,528 B2
(45) Date of Patent: Jul. 11, 2017

(54) METHOD FOR CLEANING A BARGUN DISPENSER

(75) Inventors: Juan Gonzalez, Tampa, FL (US); Steve Robbins, Land O' Lakes, FL (US); Randy Kiger, Plant City, FL (US); Rick Baron, Zephyrhills, FL (US); Steve Garbee, Brandon, FL (US); Alan Hackey, Zephyrhills, FL (US); Joshua Cox, Brandon, FL (US)

(73) Assignee: Nestec S.A., Vevey (CH)

( * ) Notice: Subject to any disclaimer, the term of this patent is extended or adjusted under 35 U.S.C. 154(b) by 190 days.

(21) Appl. No.: 14/401,579

(22) PCT Filed: May 18, 2012

(86) PCT No.: PCT/US2012/038590

§ 371 (c)(1),
(2), (4) Date: Dec. 9, 2014

(87) PCT Pub. No.: WO2013/172851

PCT Pub. Date: Nov. 21, 2013

(65) Prior Publication Data

US 2015/0101638 A1 Apr. 16, 2015

(51) Int. Cl.

| | |
|---|---|
| ***B08B 7/04*** | (2006.01) |
| ***B67D 1/07*** | (2006.01) |
| ***B67D 1/00*** | (2006.01) |

(52) U.S. Cl.

CPC ..... *B67D 1/07* (2013.01); *B67D 1/0037* (2013.01); *B67D 1/0084* (2013.01); *B67D 1/0086* (2013.01); *B67D 2001/075* (2013.01)

(58) Field of Classification Search

None

See application file for complete search history.

(56) References Cited

U.S. PATENT DOCUMENTS 5,056,686 A * 10/1991 Jarrett ..... B67D 1/0037 222/129.2
2009/0014464 A1 1/2009 Adbelmoteleb et al.

FOREIGN PATENT DOCUMENTS

| | | |
|---|---|---|
| GB | 2291041 | 1/1996 |
| WO | 0194040 | 12/2001 |
| WO | 2007107704 | 9/2007 |

OTHER PUBLICATIONS

Sta-rite, Adjusting Well Pump Pressure Switches, May 10, 2006, sta-rite, onepage.*

Installation and Operation Instruction Manual entitled "Shurflo Brix Pump 5000-2XX-XX", Rev. J Jan. 1998, 12 pages.

* cited by examiner

*Primary Examiner* — Binh X Tran
*Assistant Examiner* — David Cathey, Jr.
(74) *Attorney, Agent, or Firm* — K&L Gates LLP

(57) ABSTRACT

A method for cleaning a bargun dispenser, the method including providing a cleaning assembly containing a reservoir, a pump and fluid connection tubes; connecting the cleaning assembly to the bargun dispenser by connecting the concentrate inlet line to the reservoir in place of the source of concentrate with one of the fluid connection tubes and connecting the water inlet line to the reservoir in place of the water supply with one of the fluid connection tubes; filling the reservoir with a cleaning solution; activating the pump of the reservoir; and activating the bargun handle buttons for opening the pump outlet lines until the reservoir is empty.

9 Claims, 1 Drawing Sheet

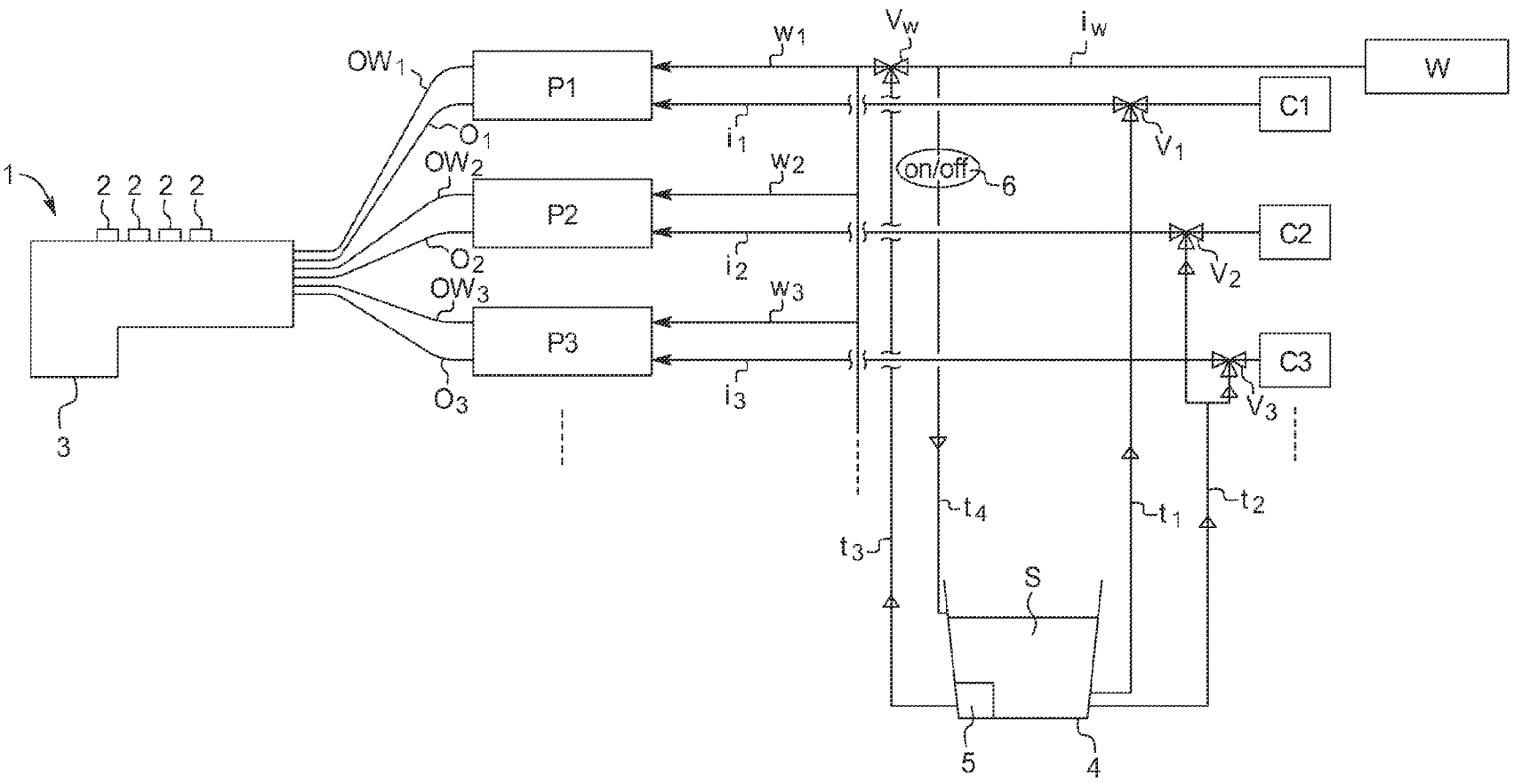
W
C1
C2
C3
V1
V2
V3
t2
t1
iw
4
S
6
on/off
t4
5
Vw
t3
w1
w2
w3
i1
i2
i3
P1
P2
P3
O1
OW2
O2
OW3
O3
OW1
2
2
2
2
3
1

METHOD FOR CLEANING A BARGUN DISPENSER

CROSS REFERENCE TO RELATED APPLICATIONS

The present application is a National Stage of International Application No. PCT/US2012/038590, filed on May 18, 2012, the entire contents of which are being incorporated herein by reference.

FIELD

The present invention relates to the cleaning of barguns.

BACKGROUND

Barguns are typically comprised of a handle having a multiplicity of buttons thereon and a nozzle situated typically perpendicular to the handle, for dispensing a preselected fluid. Bar guns are well-known in the art.

Each button activates the dispensing of a concentrate and a diluent at a specific ratio. The bargun handle is provided with the pressurized concentrate and the pressurized diluent at this specific ratio by means of a proportioning pump associated to the concentrate and the diluent. A typical proportioning pump suitable for the invention is the SHURflo Brix Pump such as described in publication 911-332 Rev. J 1/98. This publication describes the process for cleaning the proportioning pump which consists in disconnecting the concentrate inlet tube from the concentrate source and placing this tube in a bucket of cleaning solution. The pump is then activated in a first step according to a sanitizing mode and then in a second step according to a dispensing mode.

The cleaning process described in this publication presents the inconvenient of not enabling a complete cleaning of all the lines in a single operation because according to the pump sanitizing operation of the manual there are two different operations that must be successively handled by the operator. Besides if the operator does not make them correctly he must restart the operations from the beginning For bargun dispensers which are configured for dispensing several concentrates, the cleaning operation must be repeated for as many pumps as there exist concentrates which can become fastidious for the operator.

Consequently there is need for simplifying the cleaning operation of a bargun implementing proportioning pumps.

SUMMARY

According to a first aspect the invention concerns a method for cleaning in place a bargun dispenser, the bargun dispenser comprising:

- at least one source of concentrate delivering a concentrate to a concentrate inlet line,
- a source of water delivering water to a water inlet line,
- at least one proportioning pump pumping the concentrate from the concentrate inlet line and the water from the water inlet line in a determined ratio and separately delivering the pumped concentrate to a concentrate pump outlet line and the pumped water to a water pump outlet line to a bargun handle comprising buttons for opening the pump outlet lines and comprising a nozzle for mixing the pumped concentrate and the pumped water, the cleaning method comprising the following steps:

- providing a cleaning assembly comprising: a reservoir, a pump and fluid connection tubes,
- connecting the cleaning assembly to the bargun dispenser by:
  - connecting the concentrate inlet line to the reservoir in place of the source of concentrate with one of the fluid connection tubes,
  - connecting the water inlet line to the reservoir in place of the water supply with one of the fluid connection tubes,
- filling the reservoir with a cleaning solution,
- activating the pump of the reservoir, and
- activating the bargun handle buttons for opening the pump outlet lines until the reservoir is empty.

The dependent claims further define the invention.

According to a second aspect the invention concerns a clean in place (CIP) kit for cleaning a bargun dispenser, said bargun dispenser comprising:

- sources of concentrates delivering concentrates to concentrate inlet lines,
- a source of water delivering water to a water inlet line, the kit comprising:

- a cleaning assembly comprising: a reservoir, a pump and fluid connection tubes,
- three-way connecting valves adaptable on the concentrates inlet lines and on the water inlet line, each presenting an outlet configured for cooperating with one of the fluid connecting tubes.

DETAILED DESCRIPTION OF THE DRAWINGS

The characteristics and advantages of the invention will be better understood in relation to FIG. 1 which is a schematic diagram of the fluid system of a bargun dispenser and a clean in place assembly implemented in the method of the present invention.

FIG. 1 illustrates a the bargun dispenser comprising three sources of concentrate C1, C2, C3 each delivering a concentrate to a concentrate inlet line i1, i2, i3. The bargun dispenser is not limited to 3 concentrates and more concentrates could be delivered. The dispenser is linked to a source of pressurized water W which simultaneously delivers the water for diluting the concentrates but also to drive the concentrates pumps. Water is introduced through a water inlet line iw that is divided in three pump inlet lines w1, w2, w3. The dispenser comprises three proportioning pump P1, P2, P3, one for each of the concentrate: each pump pumps the concentrate from the concentrate inlet line and the water from the water inlet line in a determined ratio and separately delivers the pumped concentrate to a concentrate pump outlet line o1, o2, o3 and the pumped water to a water pump outlet line ow1, ow2, ow3. The bargun dispenser comprises a bargun handle 1 comprising buttons 2 for opening the pump outlet lines and comprising a nozzle 3 for mixing and dispensing the pumped concentrate and the pumped water.

According to the invention, for cleaning the bargun dispenser, a clean in place assembly is provided. The clean in place assembly comprises:

- a reservoir 4 for holding a cleaning or sanitizing solution or rinsing water,
- a pump 5 for pumping the liquid from the reservoir,
- fluid connection tubes t1, t2, t3, t4 for connecting the reservoir to the bargun dispenser.

Usually the reservoir comprises fluid connection fittings so that the tubes can be rapidly attached to the reservoir.

The method for cleaning the bargun dispenser with the clean in place assembly consists in the following steps. First the clean in place assembly is connected to the bargun dispenser. The connection consists in:

connecting all the concentrate inlet lines i1, i2, i3 to the reservoir 4 in place of the sources of concentrates. These connections are made by using one of the fluid connection tubes like t1 or t2. This tube is configured for connecting at least two concentrate inlet lines i2, i3 to the reservoir in place of their respective sources of concentrates C2, C3.

connecting the water inlet line iw to the reservoir 4 in place of the water supply W with one of the fluid connection tube t3. This connection is preferably configured so that the pump can provide pressurized liquid to the fluid connection tube t3 and consequently to the inlets of the pumps P1, P2, P3.

Then the reservoir 4 is filled with a cleaning solution S. According to a preferred embodiment, during the precedent step of connecting the clean in place assembly to the bargun dispenser, the water source W can be connected to the reservoir 4 in place of the bargun dispenser with a fluid connection tube t4 comprising an on/off valve 6. Then it becomes easy to fill the reservoir 4 with water from the water source W by simply opening the valve 6 until the requested quantity is reached. Specific cleaning agents can then be added to the water in the reservoir.

Preferably all the fluid connection tubes are joined together in form of a bundle to help their handling by the operator.

According to the preferred embodiment each of the concentrate inlet lines i1, i2, i3 and the water inlet line iw comprises a three-way valve v1, v2, v3, vw to which the fluid connection tubes t1, t2, t3, t4 of the clean in place assembly can be connected. These three-way valves remain in the bargun dispenser and are not dismounted between two cleaning operations. They enable the operator to quickly connect the tubes. Then he just has to manually turn all the valves in the same "cleaning" position to operate the cleaning.

Then the pump of the reservoir is activated and the bargun handle buttons for opening the pump outlet lines are activated until the reservoir is empty. The solution dispensed by the bargun nozzle is sent to drain.

The clean in place assembly can comprise a sensor for detecting the pressure downstream to the pump 5 and for stopping the pump when the pressure is higher than a predetermined value, which corresponds to the case where the bargun handle buttons are not activated.

The cleaning method can be repeated with different cleaning solutions and finally with rinsing water. The operator simply has:

to fill the reservoir with the required cleaning solution, preferably by opening the valve of tube t4 to get the volume of water needed for preparing the cleaning solution and eventually adding a sanitizing or cleaning component.

activating the buttons of the bargun handle to dispense the cleaning solution or the rinsing water.

The invention claimed is:

1. A method for cleaning a bargun dispenser comprising at least one source of concentrate delivering a concentrate to a concentrate inlet line, a source of water delivering water to a water inlet line, at least one proportioning pump pumping the concentrate from the concentrate inlet line and the water from the water inlet line in a determined ratio and separately delivering the concentrate to a concentrate pump outlet line and the water to a water pump outlet line, and a bargun handle comprising buttons for opening the concentrate pump outlet line and the water pump outlet line and comprising a nozzle for mixing and dispensing the concentrate and the water, the method comprising:

providing a cleaning assembly comprising a reservoir, a pump, and fluid connection tubes;

connecting the cleaning assembly to the bargun dispenser by connecting the concentrate inlet line to the reservoir in place of the at least one source of concentrate with a first tube of the fluid connection tubes and connecting the water inlet line to the reservoir in place of the source of water with a second tube of the fluid connection tubes, and the first tube and the second tube provided different flowpaths extending from the reservoir;

filling the reservoir with a cleaning solution;

activating the pump; and activating the buttons of the bargun handle for opening the concentrate pump outlet line and the water pump outlet line until the reservoir is empty.

2. The method according to claim 1, wherein during the step of connecting the cleaning assembly to the bargun dispenser, the source of water is connected to the reservoir in place of the bargun dispenser with a fluid connection tube comprising an on/off valve; and the reservoir is filled with the water by opening the on/off valve.

3. The method according to claim 1, wherein each of the concentrate inlet line and the water inlet line comprises a three-way valve to which the fluid connection tubes of the cleaning assembly can be connected.

4. The method according to claim 3, wherein the three-way valve is manually and/or electronically controllable.

5. The method according to claim 1, wherein the cleaning assembly comprises a sensor for detecting a pressure downstream to the pump and stopping the pump when the pressure is greater than a predetermined value.

6. The method according to claim 1, wherein the fluid connection tubes are joined together in form of a bundle.

7. The method according to claim 1, wherein the bargun dispenser comprises several sources of concentrates and several proportioning pumps associated to each concentrate.

8. The method according to claim 1, wherein at least one of the fluid connection tubes is configured for connecting at least two concentrate inlet lines to the reservoir in place of corresponding sources of concentrates.

9. The method according to Claim 1, further comprising connecting an additional tube of the fluid connection tubes to an additional concentrate inlet line, and the additional tube provides a different flowpath from the reservoir relative to the first tube and the second tube.

* * * * *